US005356322A

United States Patent [19]

Bakalis

[11] Patent Number: 5,356,322

[45] Date of Patent: Oct. 18, 1994

[54] WEBBED GLOVE FOR CONTROLLING MOVEMENT OF A WEARER'S HAND THROUGH A FLUID

[76] Inventor: Konstantine G. Bakalis, Brooklyn, N.Y.

[21] Appl. No.: 135,477

[22] Filed: Oct. 13, 1993

[51] Int. Cl.[5] ..... A63B 31/00

[52] U.S. Cl. ..... 441/57; 441/58

[58] Field of Search ..... 441/55, 56, 57, 58

[56] References Cited

U.S. PATENT DOCUMENTS

| | | | |
|---|---|---|---|
| 689,840 | 12/1901 | Jensen | 441/57 |
| 819,852 | 5/1906 | Christopher | 441/57 |
| 1,014,939 | 1/1912 | Boman . | |
| 1,275,005 | 8/1918 | Eckman | 441/57 |
| 3,023,432 | 3/1962 | Loomis . | |
| 3,231,910 | 2/1966 | Tegland . | |
| 3,257,673 | 6/1966 | Rademacher . | |
| 4,058,863 | 11/1977 | Ferdico . | |
| 4,121,312 | 10/1978 | Penney | 441/57 |
| 4,195,365 | 4/1980 | Eyman . | |
| 4,548,588 | 10/1985 | Kosuge | 441/57 |
| 4,618,328 | 10/1986 | Chi . | |
| 4,669,991 | 6/1987 | Southworth . | |

FOREIGN PATENT DOCUMENTS

| | | |
|---|---|---|
| 1514778 | 2/1968 | France . |
| 2617727 | 9/1987 | France . |
| 284111 | 1/1928 | United Kingdom . |
| 197806 | 6/1978 | United Kingdom . |

*Primary Examiner*—Stephen P. Avila
*Attorney, Agent, or Firm*—Terry M. Gernstein

[57] ABSTRACT

A glove includes webs connecting adjacent phalange-covering sections together. Each web includes an elongated flow hole, and a rib intersecting that flow hole. Fins are on the glove are located to be on the back of the wearer's hand when the glove is in position on that hand. The fins guide movement of the hand through a fluid, such as water. A closure is located on a wrist-covering portion of the glove and includes a hook-and-loop fastener that covers either a buckle or a zipper. The buckle or the zipper serves to close the glove snugly about the wearer's wrist. The glove is formed of an inner layer of material that is comfortable for the user, and an outer layer.

21 Claims, 2 Drawing Sheets

FIG.2
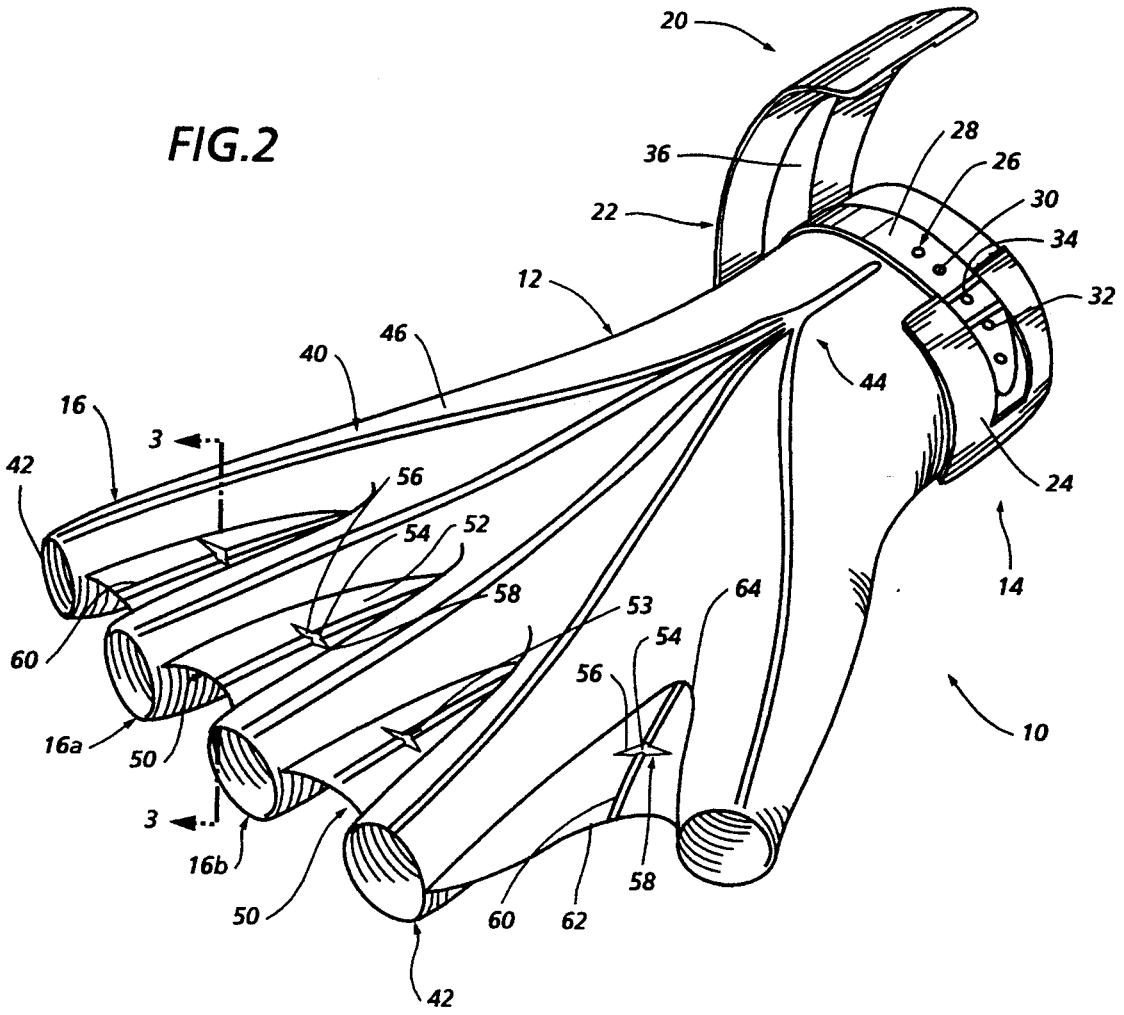
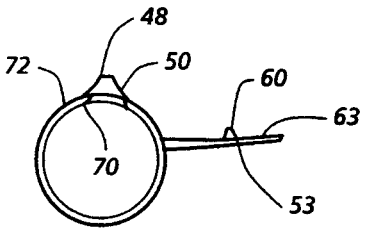
FIG.3

WEBBED GLOVE FOR CONTROLLING MOVEMENT OF A WEARER'S HAND THROUGH A FLUID

TECHNICAL FIELD OF THE INVENTION

The present invention relates to the general art of aquatics, and to the particular field of swimming.

BACKGROUND OF THE INVENTION

The benefits of swimming have long been appreciated. Modern emphasis on physical fitness has increased the number of swimmers, both recreational and competitive. These swimmers often use various aids to increase either their enjoyment of the sport or to improve their swimming skills. These aids often take the form of added weight or added resistance or stroke-specific devices.

For this reason, the art includes many devices, such as wrist weights, kickboards, leg donuts, and the like, that are intended for use by swimmers to increase their swimming skills. Even with a number of swimming accessories, there is still room for further improvement.

Any device used to improve swimming skills should not be too difficult or strenuous to use. If it is, it will not enjoy wide commercial acceptance. Still further, if the device is too strenuous, it may create a danger of injury tue to overtaxing the user's body.

Therefore, there is a need for a swimming skill improvement device that can be used by swimmers of all skill levels and will improve the skill of the user without too much stress being placed on the swimmer's muscles or joints.

Still further, a useful swimming aid should encourage a proper stroke. Many known swimming aides may assist one portion of the overall stroke, such as the arm movement, while changing another portion of the stroke, such as body position, in an adverse manner. Therefore, there is a need for a swimming aid that will assist the swimmer in developing his or her skills, yet will not cause other portions of the swimming stroke to change in an adverse manner.

Still further, any swimming aid should not be susceptible to becoming loose or deteriorating after long periods of use. Some swimming aids tend to loosen or deteriorate after time due to the harsh effects of the water, especially heavily chlorinated water. Therefore, there is a need for a swimming aid that can be used for long periods of time without deterioration or degradation.

Still further, the inventor recognizes that some swimming aids will be used in situations that they may not be designed for. An example of such misuse may occur when a swimmer dives into a pool with a kickboard, or with pull buoys on. Therefore, any swimming aid should not endanger a user even if misused. Therefore, there is a need for a swimming aid that can be misused without unduly endangering the user.

The inventor also notes that competitive or recreational swimming is only a small portion of the overall field of aquatic-related sports. SCUBA, snorkeling, surfing and the like are also extremely popular activities. These activities, like the swimming activity discussed above, have the same constraints and requirements for perfecting proper stroke technique. Therefore, there is a need for a device that can be used by swimmers as well as others engaged in various aquatic sports to improve their techniques without adversely affecting other portions of their strokes or placing too much stress on their bodies.

The inventor also notes that even skydivers require practice to develop proper techniques.

Therefore, while the present invention will be disclosed in conjunction with swimming, it is to be understood that it is equally applicable to use by a person moving through any type of fluid where proper hand movements should be developed. Thus, it is to be understood that the disclosure of swimming is merely for convenience and is the best mode, but is not to be taken as limiting the scope and coverage of this disclosure to swimming alone.

OBJECTS OF THE INVENTION

It is a main object of the present invention to provide a device that can be used to develop and perfect hand movement as a user moves through a fluid.

It is another object of the present invention to provide a device that can be used to develop and perfect hand movement as a user moves through a fluid that is efficient and not overly-stressful to use.

It is another object of the present invention to provide a device that can be used to develop and perfect hand movement as a user moves through a fluid that will improve hand movement without adversely affecting other portions of a stroke.

It is another object of the present invention to provide a device that can be used to develop and perfect hand movement as a user moves through a fluid that will improve hand movement and will not degrade after long use.

It is another object of the present invention to provide a device that can be used to develop and perfect hand movement as a user moves through a fluid that will improve hand movement that will not loosen after long periods of use.

It is another object of the present invention to provide a swimming aid.

It is another object of the present invention to provide a swimming aid that will develop and perfect a swimmer's hand movements.

It is another object of the present invention to provide a device that can be used to develop and perfect hand movement as a user moves through a fluid that will improve hand movement yet will not unduly endanger a user if misused to dive into a body of water, for example.

SUMMARY OF THE INVENTION

These, and other, objects are achieved by a webbed glove that has flow control fins thereon and flow control holes defined therein as well as size adjusting means that also tightly locks the glove onto the hand of the user. The fins and holes cause proper hand movement and proper resistance to hand movement whereby proper hand movement technique can be practiced without unduly taxing the swimmer. The controlled resistance created by the flow control holes also contributes to endurance and strength of the user. The fins are located, sized and configured to induce proper hand movement without adversely affecting the rest of the arm movement or any other part of the swimming stroke.

In this manner, the swimmer can improve his or her hand movements without endangering any other portion of the stroke or placing too much resistance on the hand movements to unduly tax the swimmer.

The webbed glove is formed of several plies of material whereby the fins are firmly anchored but can give if the swimmer dives into the water with the glove on, and the glove is durable yet comfortable for long wearing times. The glove also has size adjusting means that will permit a snug fit to be established even if the glove becomes slightly worn thereby lengthening the effective life of the glove.

BRIEF DESCRIPTION OF THE DRAWING FIGURES

FIG. 2 is a front, top and side perspective view of a first form of the webbed glove of the present invention.

FIG. 3 is a sectional view of the glove taken along line 3—3 of FIG. 2 to illustrate the various layers of the glove.

DETAILED DESCRIPTION OF THE PREFERRED EMBODIMENT OF THE INVENTION

Figure 1:
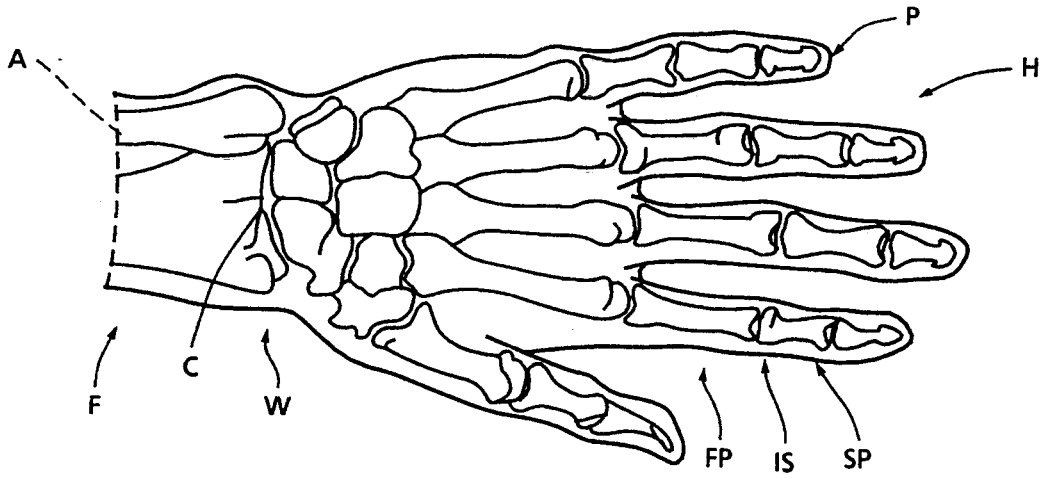
FIG. 1 illustrates a human hand for the purposes of orienting a reader to the terminology used herein.

Shown in FIG. 1 is a human hand H that includes a plurality of phalanges P, each of which includes a first, proximal row of phalanges FP joined to a second row of phalanges SP by a joint (knuckle) K. The hand is joined to a forearm F at a wrist W where the forearm ulna and radius bones join the bones associated with the hand.

Shown in FIG. 2 is a first form of a webbed glove 10 embodying the present invention. The webbed glove is intended to be worn on either hand or on both hands, and a left-handed glove is shown for the sake of convenience only. The preferred form of the glove covers the user's hand from above the wrist, over the body and over the phalanges. The preferred form of the glove covers the first, or proximal row of phalanges, but the glove can be extended to cover the second row of phalanges up to the joint (knuckle) connecting those second row of phalanges to the third or distal row of phalanges. Thus, the glove includes a body portion 12 having a wrist covering portion 14 on one end and a phalange covering portion 16 on the other end.

As shown in FIG. 2, the glove includes a closure means 20 on the wrist portion. The closure means includes a first hook-and-loop fastener section 22 that co-operates with a second hook-and-loop fastener section 24 to ensure a tight fit of the glove on a user's hand. The closure means further includes a buckle closure 26 that initially closes the glove over the user's wrist. The buckle closure includes a belt 28 having a plurality of openings, such as opening 30, defined therein. A tongue/prong element 32 is mounted on the glove and fits through one of the openings to attach the belt to the tongue. Belt loops, such as belt loop 34, hold the belt in position. Portion 22 includes a section 36 that coincides with the belt and the hook-and-loop material is located on both sides of section 36. The combination of the hook-and-loop fastener sections and the belt securely places the glove on a user's hand, and can be used to compensate for any degradation of the glove over time. The wrist portion extends up the user's wrist past area A indicated in FIG. 1 and well beyond the ends of the ulna and radial bones shown in FIG. 1 by carpals C, to add support to the wrist in the event the user dives into water while wearing the glove. The preferred form of the glove extends beyond the carpals by at least three inches. The added wrist support prevents injury to the wearer's wrist by supporting the hand from being bent backwards too far. The tight closure means also assists in this protection as it supports the wrist. Thus, the wrist-covering portion extends above the wearer's wrist joint to partially cover the radius bone of the wearer's forearm above the first row of carpal bones in the wearer's hand.

As can be best seen in FIGS. 2 and 3, the glove includes a plurality of fins 40 that extend from adjacent a distal end of each phalange-covering section, such as section 42, to a common intersection point 44 located adjacent to closure means 20. The fins are located to be on the back of the wearer's hand when the glove is on that wearer. The orientation of the fins with respect to each other and with respect to the glove has been found to assist in further controlling hand movement through the water. The fins are formed of aluminum, preferably, Aluminum alloy 3003H14 or 6061-T6, and rise above outer surface 46 of the glove. The fins are streamlined, as best shown in FIG. 3, to taper from an apex 48 to a foot 50, and are tall enough, as measured between the apex and the foot, to control movement of a user's hand through a fluid, yet are flexible so undue control of that movement is not exercised. It has been found that a fin height of 3/16 inch and a fin width as measured at the foot of the fin, of 2/16 inch achieves this desired result for the aluminum material. Other shapes, forms and dimensions of the fins will occur to those skilled in the art based on the teaching of this disclosure, and the just-mentioned forms, shapes, dimensions and materials are merely the preferred form of the invention, and are not intended to exclude other materials, shapes, forms and dimensions to satisfy special needs and requirements, such as may be associated with various swimming strokes (freestyle, backstroke, butterfly and breaststroke), as will occur to those skilled in the art based on the teaching of this disclosure.

As is also shown in FIGS. 2 and 3, the glove includes webs, such as web 50, connecting adjacent phalange-covering sections, such as sections **16*a* and 16*b*. All of the webs are similar, and thus only web 50 will be described. Web 50 includes a body section 52 that, preferably is 2/16 inch thick, and has a flow hole 52 defined therethrough. As shown, each web includes a flow hole 53 that is contoured to be an elongated slit extending transverse to the phalanges with a central enlarged section 54 between two narrow (with respect to the central section) end portions 56 and 58**. The overall length of each flow hole is 1/16 inch in the preferred form of the glove, and the transverse orientation of the flow holes has been found to add control to the glove.

Since the webs are quite thin, they are reinforced by ribs, such as rib 60, that extends the entire length of the web from its distal end 62 to its proximal end 64. As shown, the web distal ends are curved and the proximal ends are V-shaped to match the contour of the glove between adjacent phalanges. The ribs can be simple ribs, but preferably are fins similar in size, shape and function to the above-described fins 40, as indicated in FIG. 3 which shows a rib raised above a surface 63 of the web to provide further control of hand movement through the fluid. The flow holes not only control the amount of resistance to movement exerted on a user's hand as that hand is moved through a fluid, they also ensure that the webs will not tear under heavy hand/fluid pressure by permitting the fluid to move through the flow hole. The size, shape and orientation of the flow holes establishes the desired amount of resistance while also permitting sufficient flow of fluid to protect the webs.

The preferred form of the glove includes a plurality of plies, or layers as is best shown in FIG. 3. Preferably, the glove includes an inner layer 70 of neoprene rubber covered with an outer layer 72 of rubberized nylon. The material for inner layer 70 is selected to be comfortably worn on a user's skin for long periods without chaffing or the like. Fins 40 are anchored in inner layer 70 and extend through outer layer 72 as is best shown in FIG. 3.

Figure 4:
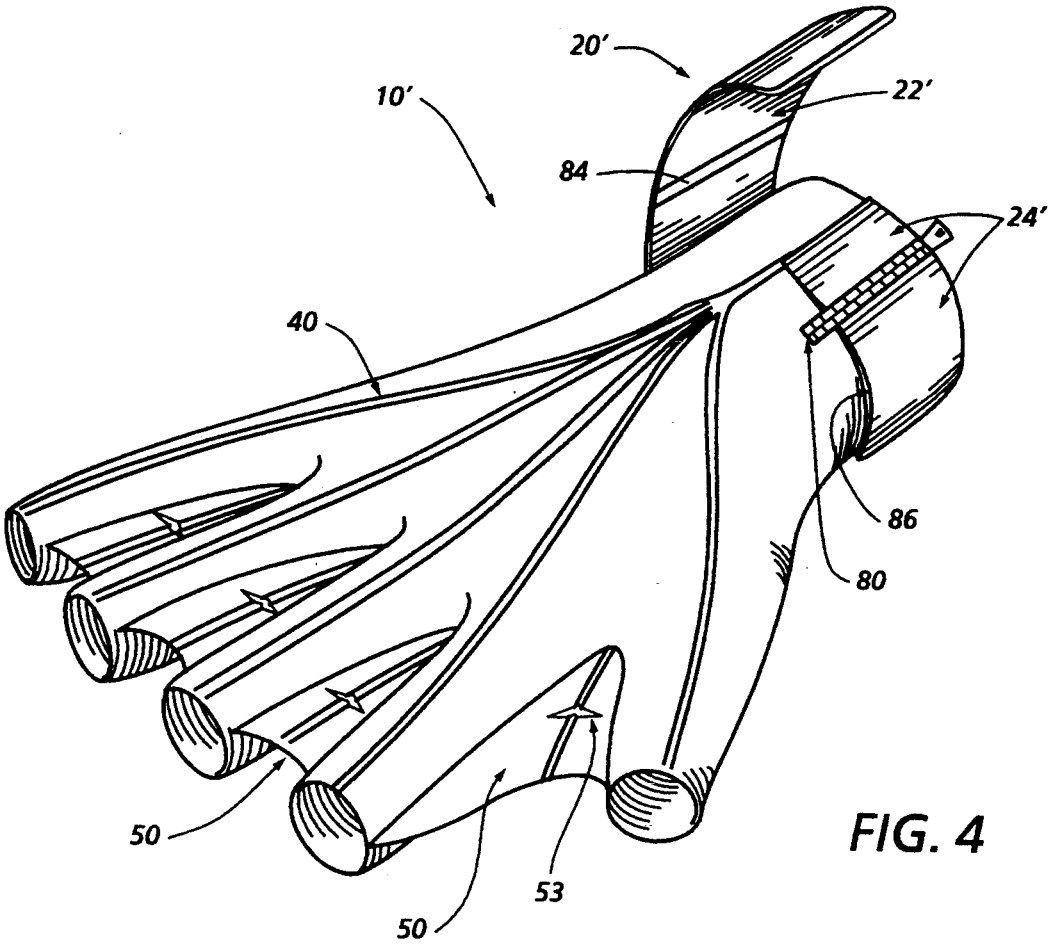
FIG. 4 is a front, top and side perspective view of a second form of the webbed glove of the present invention.

An alternative form of glove 10 is shown in FIG. 4 as glove 10'. Glove 10' is identical to glove 10 except that glove 10' includes a closure means 20' in place of closure means 20. Closure means 20' is identical to closure means 20 except that zipper 80 is substituted for buckle means 26. Zipper 80 is attached to inner layer 70 and to outer layer 72 and closes in the normal manner to tighten the glove wrist section around the wearer's wrist. The hook-and-loop fastening means covers the zipper and includes a section 84 in section 22' of the closure means 20' that coincides with the zipper when the fastening means is closed. The zipper extends beyond edge 86 of section 24' of closure means 20'.

It is understood that while certain forms of the present invention have been illustrated and described herein, it is not to be limited to the specific forms or arrangements of parts described and shown.

I claim:

1. A webbed glove for use in controlling hand movement through a fluid comprising:

A) a main portion that includes
  (1) a wrist-covering section,
  (2) a body section, and
  (3) a plurality of proximal phalange-covering sections;

B) webs connecting adjacent phalange-covering sections together;

C) a fluid flow hole defined through each web;

D) a plurality of fins extending on said body and on each of said phalange-covering sections, said fins being raised above the outer surface of said main portion;

E) a rib means on each web and extending adjacent to and past the flow hole in said each web for reinforcing said each web adjacent to the flow hole; and F) closure means on said wrist-covering section for closing said wrist-covering section.

2. The glove defined in claim 1 wherein said closure means includes a hook-and-loop fastener.

3. The glove defined in claim 2 wherein said closure means further includes a buckle.

4. The glove defined in claim 3 wherein said closure means includes a channel section on said hook-and-loop fastener corresponding to said buckle.

5. The glove defined in claim 2 wherein said closure means further includes a zipper.

6. The glove defined in claim 2 wherein said main portion includes two layers which include an inner layer and an outer layer.

7. The glove defined in claim 6 wherein said inner layer is neoprene rubber, and said outer layer is rubberized nylon.

8. The glove defined in claim 7 wherein said fins are aluminum and are connected to said inner layer and extend through said outer layer.

9. The glove defined in claim 8 wherein said fins are 3/16 inch in height as measured between an apex thereof and a foot thereof.

10. The glove defined in claim 9 wherein said fins are 2/16 inch thick as measured between the sides of each fin adjacent to the base of said fin.

11. The glove defined in claim 10 wherein each web is 2/16 inch thick.

12. The glove defined in claim 1 wherein each flow hole is elongate.

13. The glove defined in claim 12 wherein each flow hole is 1/16 inch long.

14. The glove defined in claim 1 wherein said rib means is triangular in cross-sectional shape.

15. The glove defined in claim 12 wherein each flow hole has an enlarged central section, and each rib intersects each flow hole at said central section.

16. The glove defined in claim 15 wherein each web includes an arcuate edge.

17. The glove defined in claim 1 wherein said wrist-covering portion extends above a user's wrist joint.

18. The glove defined in claim 1 wherein said fins emanate from a common point located adjacent to said closure means.

19. The glove defined in claim 12 wherein each rib is raised above a surface of said web adjacent to said flow hole.

20. The glove defined in claim 12 wherein each of said flow holes includes a central section and two end sections that are smaller than said central section, and each flow hole is oriented transversely of said phalanges whereby each end section is located adjacent a phalange.

21. A webbed glove for use in controlling hand movement through a fluid comprising:

A) a main portion that includes
  (1) a wrist-covering section,
  (2) a body section, and
  (3) a plurality of proximal phalange-covering sections;

B) webs connecting adjacent phalange-covering sections together;

C) a fluid flow hole defined through each web;

D) a plurality of fins extending on said body and on each of said phalange-covering sections, said fins being raised above the outer surface of said main portion;

E) a rib means on each web for reinforcing said each web, each rib means extending above the surface of said each web and including a first portion extending from adjacent to a base of the web adjacent to said body section to adjacent to the fluid flow hole defined in the web, and a second portion extending from adjacent to the fluid flow hole defined in the web to adjacent to a forward edge of the web; and F) closure means on said wrist-covering section for closing said wrist-covering section.

* * * * *